US006076990A

United States Patent [19]

Jahn

[11] Patent Number: 6,076,990

[45] Date of Patent: Jun. 20, 2000

[54] BINDER FOR HOLED PAPER

[76] Inventor: Gerry Jahn, 225 Sterling Road, Toronto, Ontario, Canada, M6R 2B2

[21] Appl. No.: 08/933,508

[22] Filed: Sep. 18, 1997

[30] Foreign Application Priority Data

Aug. 8, 1997 [CA] Canada ..... 2212528

[51] Int. Cl.[7] ..... B42D 1/08; B42F 3/00

[52] U.S. Cl. ..... 402/70; 402/68; 402/61; 402/64; 402/80 P; 281/22; 281/36; 281/15

[58] Field of Search ..... 402/68, 61, 64, 402/80, 22, 32, 71, 77, 59, 60, 4; 281/22, 45, 51, 15.1; 248/451

[56] References Cited

U.S. PATENT DOCUMENTS

| | | | |
|---|---|---|---|
| 238,233 | 3/1881 | Hartung | 281/22 |
| 665,256 | 1/1901 | McComb . | |
| 3,260,264 | 7/1966 | McKowen | 129/23 |
| 3,574,472 | 4/1971 | Cott | 402/22 |
| 4,340,316 | 7/1982 | Jahn | 402/68 |
| 4,673,608 | 6/1987 | Cline | 428/182 |
| 5,028,075 | 7/1991 | Donnelly | 281/49 |
| 5,040,216 | 8/1991 | Policht | 281/46 |
| 5,433,481 | 7/1995 | Corbishley | 281/45 |
| 5,538,287 | 7/1996 | Ozeki | 281/15.1 |
| 5,893,585 | 4/1999 | Worthen | 281/45 |

*Primary Examiner*—Willmon Fridie, Jr.
*Assistant Examiner*—Alisa L. Thurston

[57] ABSTRACT

A binder for sheets of paper comprises a bendable cover and a binding system secured centrally of the cover. The binding system has a one piece plastic construction comprising a base portion with first and second bosses formed from and located to either side of the base portion. The first boss has a plurality of spaced apart recesses and the second boss has a plurality of spaced apart posts which lock into the recesses of the first boss when the binder is folded upon itself in a binding position. Also provided are first and second sets of ribs again formed from the base between the first and second bosses. The ribs are hollow and are open from beneath to ease the bending of the binding system when the binder is folded to the binding position.

5 Claims, 1 Drawing Sheet

BINDER FOR HOLED PAPER

FIELD OF THE INVENTION

The present invention relates to a plastic binder for punched paper.

BACKGROUND OF THE INVENTION

U.S. Pat. No. 4,340,316, issued Jul. 12, 1982, to Gerhard Jahn describes a paper binder including a cover portion having a spine fitted with interlocking male and female members to receive punched paper. The female members and the male members are provided on individual pieces of plastic separately secured at the spine of the binder.

The above system relies on a relatively heavy duty cover having a spine provided with preformed folds allowing the male and female parts to come together with one another. In addition and because the male and female parts are mounted independently of one another to the cover, it is possible to improperly assemble the binder such that the posts on the male member do not properly align with the recesses on the female member preventing the binder from closing.

From an inventory control standpoint, when working with two independent parts, i.e. the male and the female parts, it is possible that one of the parts can be lost rendering the other part useless.

SUMMARY OF THE INVENTION

The present invention provides a binding system which does not suffer from any of the drawbacks noted immediately above. More particularly, the binding system of the present invention, which is attachable to a foldable cover in forming a completed binder, has a one piece plastic construction. This construction comprises a base portion with first and second bosses formed from and to either side of the base portion. The first boss has a plurality of spaced apart recesses and the second boss has a plurality of spaced apart posts which lock into the recesses when the binder is folded upon itself in a binding position.

Also provided are first and second sets of ribs again formed from the base between the first and second bosses. Each of the ribs is hollow and has an open bottom which eases the bending of the base at the ribs when the system is folded with the binder to the binding position.

BRIEF DESCRIPTION OF THE DRAWINGS

The above as well as other advantageous and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
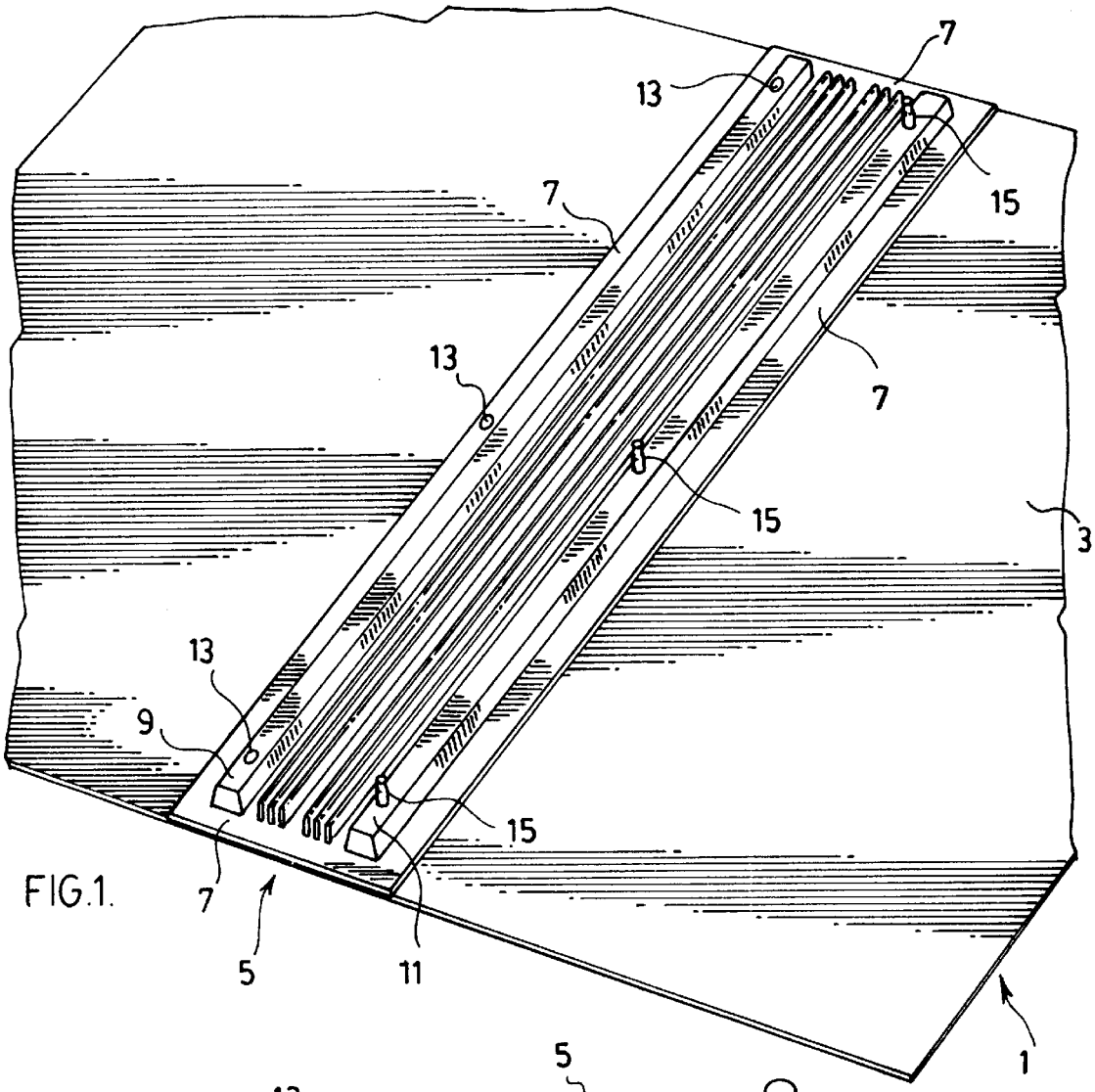
FIG. 1 is a perspective view of a binder according to a preferred embodiment of the present invention.

FIG. 1 shows a binder generally indicated at 1. This binder is formed with a cover 3 to which is secured a binding system generally indicated at 5.

Cover 3 in the embodiment shown comprises a very thin piece of flexible plastic, preferably polyvinyl chloride. This particular cover has a thickness about the same as that of a piece of bristle board paper and is very soft and bendable. It does not necessarily have any preformed fold regions.

The cover could also be substantially thicker, for example, formed from separate pieces of plastic welded to opposite sides of an internal stiffener.

Binding system 5 is located centrally of and forms a spine for the cover. The binding system has a one piece plastic construction. Again, it is preferably made from polyvinyl chloride.

Figure 2:
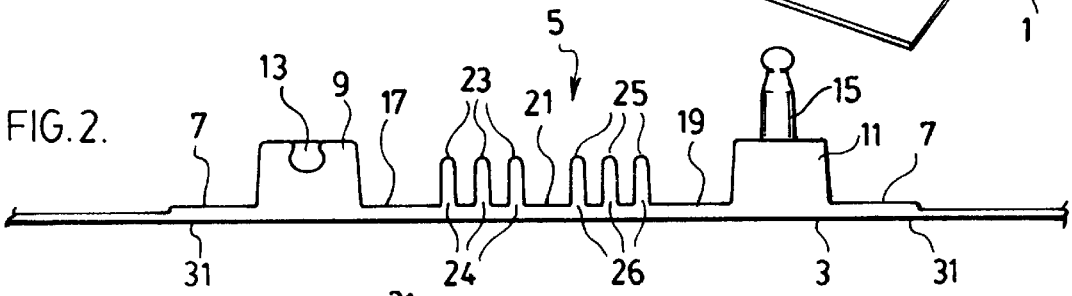
FIG. 2 is a sectional view through the spine region of the binder of FIG. 1.

The binding system is formed from a base, preferably vacuum formed, to the profile shown in FIG. 2. The thickness of the base is approximately the same as the thickness of their cover described above but substantially more rigid.

The profiled portions of the base comprise first and second hollow bosses 9 to opposite sides of the base. There is a foot portion 7 outside of each boss and around opposite ends of the base.

Figure 3:
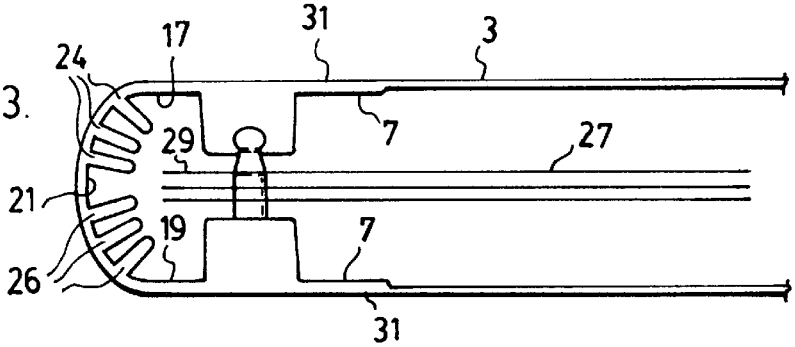
FIG. 3 is a view similar to FIG. 2 showing the binder in the binding position.

Boss 9, as best seen in FIG. 1, is provided with a plurality of recesses 13. A corresponding number of posts 15 are formed in the boss 11. Posts 15 lock into recesses 13 when the binder is folded to a binding position as shown in FIG. 3.

The key to the present invention lies in the feature that the two bosses 9 and 11 are part of the same unitary construction. This ensures that the posts are always properly aligned with the recesses for holding the binder closed.

Located between the two bosses are first and second sets of ribs 23 and 25 respectively. Again these ribs are vacuum formed from the base material of the binding system such that each of the ribs is hollow. Ribs 23 have open bottoms 24. Ribs 25 have open bottoms 26.

A first flat region 17 of the binding system separates posts 23 from boss 9 while a second flat region 19 separates boss 11 from ribs 25. A third flat region 21 is provided between the sets of ribs centrally of the binding system.

As will be understood from a very rudimentary knowledge of vacuum forming the material in the binding system where vacuum formed is thinner and weaker than the non-vacuum formed regions. In particular, the material at the ribs is relatively thin and more flexible than the material at the flat regions to either side of and between the ribs.

Binding system 5 is preferably secured by welding it to the cover at the foot 7 of the base in the secured area 31. This leaves everything interiorly of the foot free to bend or flex independently of the cover.

As best seen in FIG. 3 of the drawings, the binding system is easily folded upon itself with the cover to the binding position without cracking the material in the binding system. One of the factors to ease the bending or folding of the binding system is that the bottom ends of each of the ribs tends to open or separate substantially reducing stress and allowing a uniform curvature at each of the rib sets. The center flat region 21 of the binding system provides rigidity in this area and prevents the spine of the binder from going completely limp.

It should be noted that all of the ribs are of uniform height and are not tall enough to interfere with bending of the binder spine. The height of the ribs will be totally dependent on the size of the binder. From a relative standpoint, the height of the ribs should not be any greater and is preferably less than the height of the two bosses. In fact, the height of the ribs is preferably less than the width across each of the flat regions 17 and 19 between the rib sets and the bosses.

The flat regions 17 and 19 provide spacers between the ribs and the bosses to either side of the binding system.

Therefore when paper sheets 27 are held within the binder the ends 29 of these sheets have clearance relative to the ribs as shown in FIG. 3.

As will be appreciated from the above, the binding system of the present invention is not only efficient from a paper holding standpoint but also extremely efficient from a mounting standpoint relative to the cover. Regardless of how the binding system is mounted, the posts will always line up with the recesses into which they are to be fitted and there is no possibility of separate binding pieces being lost from one another in inventory.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A binding system having a one piece plastic construction comprising an outside foot region for securing said binding system to a foldable cover in forming a complete binder, first and second bosses upstanding relative to and bordered by said foot region, said first boss having a plurality of spaced apart recesses and said second boss having a plurality of spaced apart posts which lock into said recesses when said system is folded upon itself in a binding position, and first and second sets of hollow open bottomed ribs also upstanding relative to said foot portion, said first and second sets of ribs being located between said first and second bosses and being separated from said bosses and from one another by flat regions of said binding system which are generally level with said foot region when said binding system lays flat in a non-binding position.

2. The binding system as claimed in claim 1 wherein said flat regions comprise has a first flat region between said first set of ribs and said first boss, a second flat region between said second set of ribs and said second boss, and a third flat region between said first and second sets of ribs centrally of said base.

3. A binding system as claimed in claim 1 when all of said ribs are of substantially the same height and wherein said first region and second flat region have a width at least as great as the height of said ribs.

4. A binding system as claimed in claim 1 wherein said ribs have a height less than that of said bosses.

5. A binder comprising a foldable plastic cover and a binding system centrally of said cover, said binding system having a one piece plastic construction comprising an outside foot region which secures said binding system to said cover, first and second bosses upstanding relative to and bordered by said foot region, said first boss having a plurality of spaced apart recesses and said second boss having a plurality of spaced apart posts which lock into said recesses when said system is folded upon itself in a binding position, and first and second sets of hollow open bottomed ribs also upstanding relative to said foot region, said first and second sets of ribs being located between said first and second bosses and being separated from said bosses and from one another by flat regions of said binding system which are generally level with said outside foot region when said binding system lays flat in a non-binding position, said binding system being secured to said plastic cover at said foot region with said sets of ribs and said flat regions being free to move relative to said cover.

* * * * *